US005478356A

United States Patent [19]

Kaaret

[11] Patent Number: 5,478,356

[45] Date of Patent: Dec. 26, 1995

[54] CYANOAMINES AND COMPOSITIONS USEFUL FOR BLEACHING

[75] Inventor: Thomas W. Kaaret, Alamo, Calif.

[73] Assignee: The Clorox Company, Oakoand, Calif.

[21] Appl. No.: 240,248

[22] Filed: May 10, 1994

[51] Int. Cl.[6] ..... D06L 3/02; C11D 3/28; C11D 3/395

[52] U.S. Cl. ..... 8/111; 252/102; 252/186.38; 252/186.39; 134/2

[58] Field of Search ..... 252/186.38, 102, 252/186.39; 8/111; 134/2

[56] References Cited

U.S. PATENT DOCUMENTS

| | | | |
|---|---|---|---|
| 2,992,223 | 7/1961 | Frazza et al. | 260/281 |
| 3,583,924 | 6/1971 | Demangeon et al. | 252/102 |
| 4,199,466 | 4/1980 | Benson, Jr. | 252/95 |

OTHER PUBLICATIONS

Makhon'kov et al., "Reactions of Tetracyanomethane and Chlorotricyanomethane with the Anions of Dibasic Acid Imides," *J. Org. Chem., USSR* (English translation), 13, pp. 890–893 (1977).

Sheludyakov et al., "Synthesis and Properties of Diacylcarbamoyl Chlorides and Compounds Derived from Them," *J. Gen. Chem. USSR* (English translation), 47, pp. 974–978 (1977).

*Primary Examiner*—Paul Lieberman
*Assistant Examiner*—Gregory R. Delcotto
*Attorney, Agent, or Firm*—Majestic, Parsons, Siebert & Hsue

[57] ABSTRACT

Cyanoamine activators give excellent bleaching performance when combined with a peroxygen source and dissolved in solution. Activators include imides wherein each activator has two acyl groups attached to a common nitrogen and to a cyclic moiety, with the nitrogen being cyano substituted. The two acyl groups form intermediate peroxy groups in the presence of a peroxygen source in solution. Preferred activators include N-cyanophthalimide and N-cyanosuccinimide.

29 Claims, 1 Drawing Sheet

CYANOAMINES AND COMPOSITIONS USEFUL FOR BLEACHING

FIELD OF THE INVENTION

The present invention relates to compounds which react with a peroxygen source to form oxidant species, and particularly to cyanoamines that can react with a peroxygen source to yield an effective bleaching agent.

BACKGROUND OF THE INVENTION

Peroxy compounds are effective bleaching agents, and compositions including mono- or diperoxyacid compounds are useful for industrial or home laundering operations. For example, U.S. Pat. No. 3,996,152, issued Dec. 7, 1976, inventors Edwards et al., discloses bleaching compositions including peroxygen compounds such as diperazelaic acid and diperisophthalic acid.

However, granular bleaching products containing peroxyacid compounds tend to lose bleaching activity during storage, due to decomposition of the peroxyacid. The relative instability of peroxyacid presents a problem of storage stability for compositions consisting of or including peroxyacids.

One approach to the problem of reduced bleaching activity of peroxyacid compositions has been to include "activators" for, or precursors of, peroxyacids. U.S. Pat. No. 4,283,301, inventor Diehl, issued Aug. 11, 1981, discloses bleaching compositions including peroxygen bleaching compounds, such as sodium perborate monohydrate or sodium perborate tetrahydrate, and activator compounds such as isopropenyl hexanoate and hexanoyl malonic acid diethyl ester. However, these bleach activators tend to yield an unpleasant odor under actual wash conditions.

Another approach has been the use of cyanamides and nitriles which can react with alkaline hydrogen peroxide to form a peroxyimidic intermediate, which is a powerful oxidant. Thus, for example, Payne, *Tetrahedron,* 18, pp. 763–765 (1962) describes the reaction of benzonitrile and hydrogen peroxide to give an extremely reactive intermediate termed peroxybenzimidic acid. This intermediate is too reactive to be isolated, and actually will oxidize hydrogen peroxide itself to oxygen. Sawaki, *Bull. Chem. Soc.* Jpn., 54, pp. 793–799 (1981) summarized the reaction described by Payne, supra and also studied the effect of certain substituted benzonitriles (p-MeOPhCN, p-MePhCN, m-MePhCN, o-MePhCN, p-ClPhCN, and p-$O_2$NPhCN.

U.S. Pat. No. 4,756,845, issued Jul. 12, 1988, inventors Sugawara et al., discloses peroxide activators such as alkyl or alkoxy substituted dicyanobenzenes.

European patent application 91201170.7, published Nov. 27, 1991, inventor Oakes discloses peroxyacid bleach precursors that are prepared from an aromatic aldehyde or ketone by reaction with sodium cyanide and a dialkyl amine.

Furthermore, U.S. Pat. No. 4,199,466, issued Apr. 22, 1980, inventor Benson, discloses that certain cyanoamine compounds, such as N-cyanomonoalkylamines, N-cyanodialkylamines, N-cyanomonocycloalkylamines, N-cyanomonoheterocyclicamines, N-cyanoaralalkylamines, and N-cyano-N-(alkoxyaralkyl)amine, when employed under alkaline conditions act as activators of peroxide-based bleaches.

However, problems with the previously known cyanoamines, cyanamides, and nitriles activators have included limited stability, poor bleaching effectiveness, and low yields of active oxidizing intermediates.

SUMMARY OF THE INVENTION

It is an object of the present invention to provide activator compounds useful for bleaching applications.

In one aspect of the present invention a composition, useful for bleaching, comprises an imide, as the activator compound, having two acyl groups attached to a common nitrogen and to a cyclic moiety, with the nitrogen being cyano substituted. The composition further includes a peroxygen source in a sufficient amount to form an oxidizing agent derivative of the activator compound when the peroxygen source and the activator compound are admixed in a solvent therefor. The solvent will typically be aqueous based, such as in laundry (washing machine) applications. The peroxygen source preferably is in an amount that provides peroxygen in a molar ratio with respect to activator compound of about 1:1 or greater.

The composition preferably includes a pH adjusting agent and/or a metal sequestering agent. The pH adjusting agent, when present, is effective to adjust or to maintain the pH of a solution in which the oxidizing agent is intended to be dissolved, preferably an aqueous based solution, to a pH greater than about 7.5. The metal sequestering agent, when present, preferably includes a phosphonate, amino phosphates, or a mixture thereof.

Embodiments of the invention are compounds that have either of the following structures

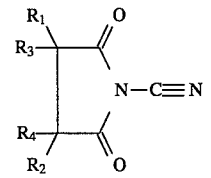

or

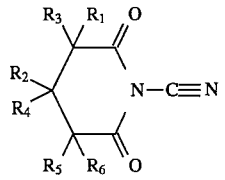

where $R_1$ and $R_2$ taken together with the carbon atoms to which they are attached form a ring containing 4 to 6 carbon atoms, whereby the carbon atoms in the ring may be singly or multiply substituted with hydrogen, $C_1$–$C_{20}$ alkyl, $C_1$–$C_{20}$ alkoxy, $C_1$–$C_{20}$ alkanoyl, phenyl, benzoyl, middle halogen, amino, amine salt, phosphate or phosphonate group, sulfate or sulfonate group, cyano or cyanoamino group, or with a cyclic group of 4 to 6 carbon atoms, or with a nitrogen-containing heterocyclic group of 4 to 6 atoms; or where $R_1$ and $R_2$ taken together with the carbon atoms to which they are attached form a heterocyclic ring containing 5 to 7 atoms containing one or two hetero atoms selected from the group consisting of O, S, and N—$R_7$, where $R_7$ is hydrogen or a $C_1$–$C_{20}$ alkyl, $C_1$–$C_{20}$ alkoxy, $C_1$–$C_{20}$ alkanoyl, $C_2$–$C_{20}$ alkenyl, $C_2$–$C_{20}$ alkynyl, phenyl, benzoyl, middle halogen, amino, amine salt, phosphate or phosphonate group, sulfate or sulfonate group, cyano or cyanoamino group; and where $R_3$, $R_4$, $R_5$, and $R_6$ are the same or different and independently represent hydrogen, $C_1$–$C_{20}$ alkyl (straight chain, branched chain, or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, benzoyl, $C_7$–$C_{20}$ aralkyl, alkenylcyanoamino; or where $R_1$, $R_2$, $R_3$, $R_4$, $R_5$, and $R_6$ are the same or different and independently represent hydrogen, $C_1$–$C_{20}$ alkyl (straight chain, branched chain, or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, benzoyl, $C_7$–$C_{20}$ aralkyl, alkenylcyanoamino, or a polyalkenylamino of the type $$\left(\begin{array}{c} R_8 \\ | \\ N-(CH_2)_n \end{array}\right)_x$$

where n=1 or 2 and X is 1–10 and $R_8$ is hydrogen or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or an amine salt, carboxylate, phosphate or phosphonate group, sulfate or sulfonate group, cyano, cyanoamino or hydroxyl group.

Particularly preferred activators include N-cyanophthalimide and N-cyanosuccinimide.

DETAILED DESCRIPTION OF THE PREFERRED EMBODIMENTS

Figure 1:
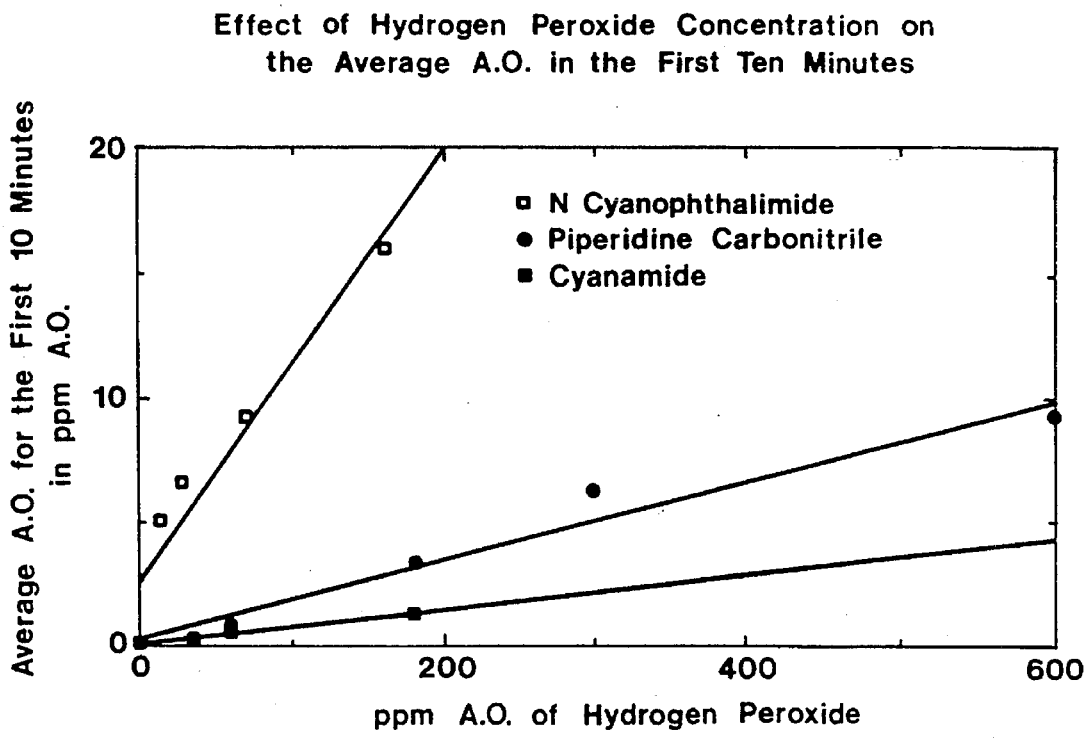
FIG. 1 is a graph of the effect of hydrogen peroxide concentration on the average active oxygen.

Compositions of the invention are contemplated for bleaching applications, particularly where aqueous based bleaching solutions are used to bleach stains on fabrics during laundering. The inventive composition is expected to provide bleaching or cleaning of a wide variety of items including laundry, dishes, textiles, paper, and wood pulp.

Particularly preferred compositions of the invention are in granular form, although liquid forms are possible so long as the activator and the peroxygen source are kept from reacting until desired. If liquid hydrogen peroxide is the peroxygen material, it may be necessary to keep it separated from the activator prior to addition to the wash liquid, so as to avoid premature decomposition and generation of active oxygen. An example of a practical execution of a liquid delivery system is to dispense separately metered amounts of the precursor (in some nonreactive fluid medium) and liquid hydrogen peroxide in a container such as described in Beacham et al, U.S. Pat. No. 4,585,150, commonly assigned to The Clorox Company, and incorporated herein by reference.

Activator compounds of the invention have either of the following structures

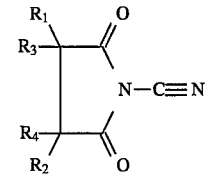

or

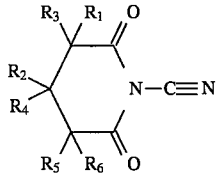

where $R_1$ and $R_2$ taken together with the carbon atoms to which they are attached form a ring containing 4 to 6 carbon atoms, whereby the carbon atoms in the ring may be singly or multiply substituted with hydrogen, $C_1$–$C_{20}$ alkyl, $C_1$–$C_{20}$ alkoxy, $C_1$–$C_{20}$ alkanoyl, phenyl, benzoyl, middle halogen (Cl, Br, or I), amino, amine salt, phosphate or phosphonate group, sulfate or sulfonate group, cyano or cyanoamino group, or with a cyclic group of 4 to 6 carbon atoms, or with a nitrogen-containing heterocyclic group of 4 to 6 atoms; or where $R_1$ and $R_2$ taken together with the carbon atoms to which they are attached form a heterocyclic ring containing 5 to 7 atoms containing one or two hetero atoms selected from the group consisting of O, S, and N—$R_7$, where $R_7$ is hydrogen or a $C_1$–$C_{20}$ alkyl, $C_1$–$C_{20}$ alkoxy, $C_1$–$C_{20}$ alkanoyl, $C_2$–$C_{20}$ alkenyl, $C_2$–$C_{20}$ alkynyl, phenyl, benzoyl, middle halogen, amino, amine salt, phosphate or phosphonate group, sulfate or sulfonate group, cyano or cyanoamino group; and where $R_3$, $R_4$, $R_5$, and $R_6$ are the same or different and independently represent hydrogen, $C_1$–$C_{20}$ alkyl (straight chain, branched chain, or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, benzoyl, $C_7$–$C_{20}$ aralkyl, alkenylcyanoamino; or where $R_1$, $R_2$, $R_3$, $R_4$, $R_5$, and $R_6$ are the same or different and independently represent hydrogen, $C_1$–$C_{20}$ alkyl (straight chain, branched chain, or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, benzoyl, $C_7$–$C_{20}$ aralkyl, alkenylcyanoamino, or a polyalkenylamino of the type $$\left(\begin{array}{c} R_8 \\ | \\ N-(CH_2)_n \end{array}\right)_x$$

where n=1 or 2 and X is 1–10 and $R_8$ is hydrogen or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or an amine salt, carboxylate, phosphate or phosphonate group, sulfate or sulfonate group, cyano, cyanoamino or hydroxyl group.

Particularly preferred activators include N-cyanophthalimide and N-cyanosuccinimide, which have the following structures:

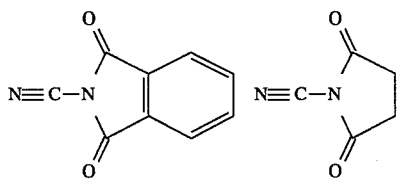

As is apparent these preferred activators comprise imides, wherein each activator has two acyl groups attached to a common nitrogen and to a cyclic moiety, with the nitrogen being cyano substituted. The two acyl groups form intermediate peroxy groups in the presence of a peroxygen source in a solution.

Active Oxygen Generation Measurements

Electrochemical experiments were performed to measure the amount of active oxygen (AO) generated by eight nitriles and cyanoamines in the presence of hydrogen peroxide. These compounds were examined under an identical set of experimental conditions at a pH of 10.8. This pH was chosen based on results that the amount of AO increased with increasing pH for cyanamide, morpholine carbonitrile, and piperidine carbonitrile. Results from the electrochemical experiments are set forth in Tables 1 and 2.

Figure 2:
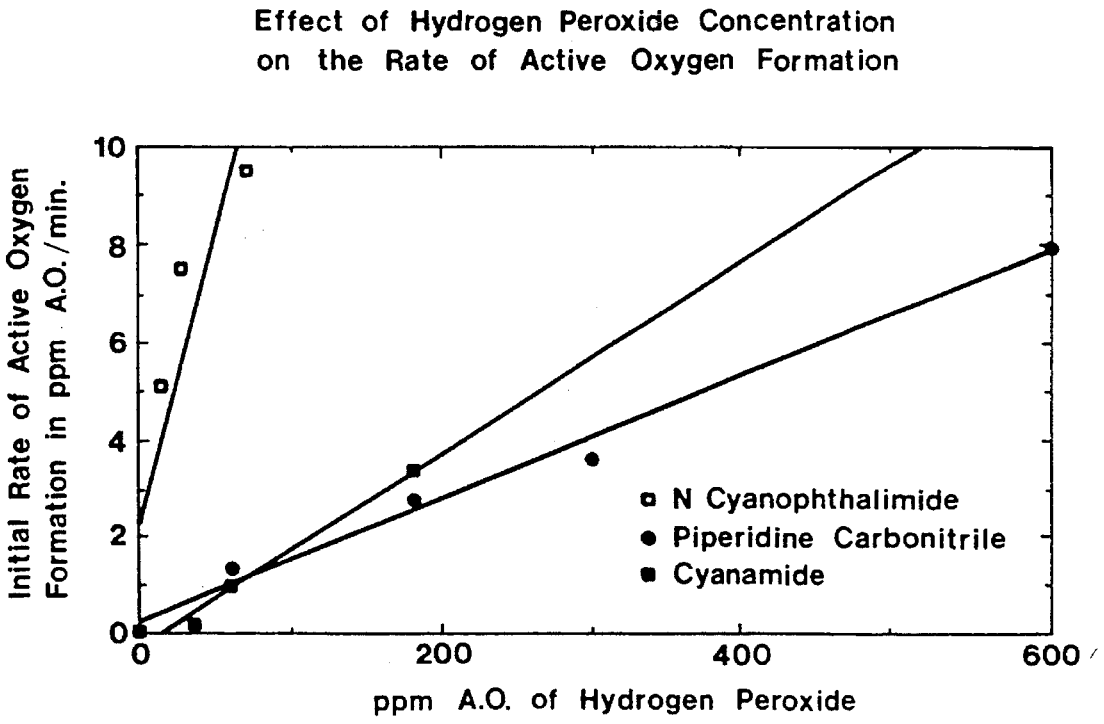
FIG. 2 is a graph of the effect of hydrogen peroxide concentration on the rate of active oxygen formation.

The effect of hydrogen peroxide concentration on the rate of AO formation and average AO was also tested. As expected, increasing the amount of hydrogen peroxide increased both the rate of AO formation and the average AO as shown by the results displayed in FIGS. 1 and 2. Experimental results for FIGS. 1 and 2 were obtained in pH 10.8 solutions using 80 ppm AO nitrile and a two-fold excess of hydrogen peroxide. The solution of piperidine carbonitrile contained 2% alcohol to help dissolve the carbonitrile. Solutions of FIG. 2 contain 80 ppm Dequest 2006™, (Monsanto Co.), a sequestering agent.

TABLE 1*

Initial Rate of Average Oxygen Formations in Nitrile and Cyanoamine Solutions

| Compound | Initial Rate (in ppm AO/min) 80 ppm Deguest 2006 ™ | No Dequest 2006 ™ |
|---|---|---|
| N-Cyanophthalimide | 14.8 | 19.4 |
| Cyanamide | 2.1 | 3.4 |
| N-,N-Diethylcyanamide | 0.6 | 2.5 |
| Piperidine carbonitrile | Not Available | 2.6 |
| Morpholine carbonitrile | 2.6 | 1.7 |
| N-Cyanoenanthamide | <0.1 | <0.1 |
| N-Cyanolauromide | <0.1 | <0.1 |

TABLE 2*

Average Oxygen Present During the First 10 Minutes in Nitrile and Cyanoamine Solutions

| Compound | Average AO (in ppm AO) 80 ppm Dequest 2006 ™ | No Dequest 2006 ™ |
|---|---|---|
| N-Cyanophthalimide | 14 | 16.1 |
| Cyanamide | 6.4 | 1.4 |
| N,N-Diethylcyanamide | 3.4 | 2.9 |
| Morpholine carbonitrile | 2.2 | 1.5 |
| N-Cyanoenanthamide | 0.2 | 0.2 |
| N-Cyanolauromide | <0.1 | <0.1 |

*Experimental conditions for the results given in Tables 1 and 2 were obtained in solutions of pH 10.8 using approximately 80 ppm AO in activator (except N-cyanophthalimide which was tested at 35 ppm AO) and a two-fold excess of hydrogen peroxide. Solutions of piperidine carbonitrile and morpholine carbonitrile contained 2% by volume alcohol to help dissolve the carbonitriles.

Synthesis and Analysis of N-Cyanophthalimide

N-Cyanophthalimide was prepared, as shown in Reaction 1, under a dry atmosphere from a 1:1 mixture of phthaloyl dichloride and 1,3-bis(trimethylsilyl) carbodiimide using 1,2,4-trimethylbenzene as solvent. Two drops of tin(IV) chloride were added as a catalyst before heating the mixture to 60° C. for six hours. The reaction mixture was cooled, filtered, and washed with chilled toluene giving yellow crystals as product.

REACTION 1

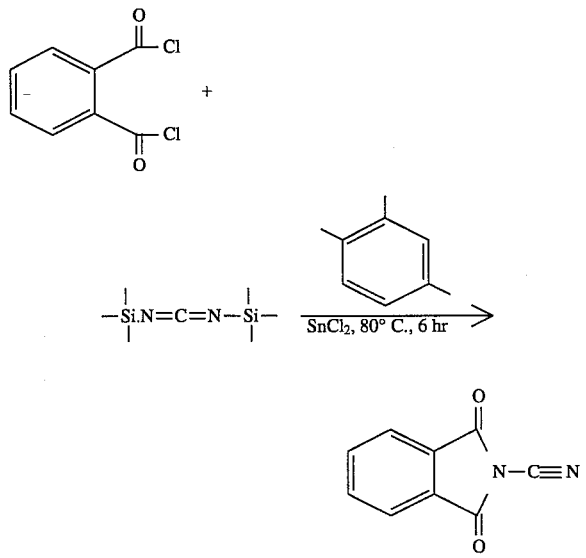

Filter and wash product with toluene

Electrochemical measurements of average AO in pH 10.8 solutions showed that N-cyanophthalimide maintained the highest level of conversion to a peroxyimidic moiety compared to any of the nitrile or cyanoamine derivatives tested, as shown in Table 3. The data also indicate that N-cyanophthalimide does not require the addition of Dequest 2006™ to achieve efficient AO generation, unlike the other cyanoamines tested. N-Cyanophthalimide is also more efficient at AO generation at lower pH than the other cyanoamines which have been tested, as shown in Table 4. Cyanamide, piperidine carbonitrile, and morpholine carbonitrile display no observable active oxygen formation below pH 10 at room temperature.

TABLE 3*

| Compound | Percent Conversion of Activator to an Active Oxidant Within the First Ten Minutes of Hydrogen Peroxide Addition: 80 ppm Deguest 2006 ™ | No Dequest 2006 ™ |
|---|---|---|
| N-Cyanophthalimide | 28% | 32% |
| Cyanamide | 8% | 2% |
| N,N-Diethylcyanamide | 4% | 3% |
| Piperidine carbonitrile | 3% | 3% |
| Morpholine carbonitrile | 3% | 3% |
| N-Cyanoenanthamide | <1% | <1% |
| N-Cyanolauromide | <1% | <1% |

*Experimental results were obtained at room temperature in pH 10.8 solutions using 80 ppm AO nitrile (except N-cyanophthalimide was at 50 ppm AO), a two-fold excess of hydrogen peroxide, and Dequest 2006 ™ as noted. The solutions of piperidine carbonitrile and morpholine carbonitrile contained 2% alcohol to help dissolve the carbonitrile.

TABLE 4*

| pH | 80 ppm Deguest 2006 ™: Initial Rate (ppm AO/min) | Average AO (ppm AO) | % Converted | No Dequest 2006 ™: Initial Rate (ppm AO/min) | Average AO (ppm AO) | % Converted |
|---|---|---|---|---|---|---|
| 10.8 | 14.8 | 14 | 28 | 19.4 | 16 | 32 |
| 9.5 | 28.4 | 22.9 | 46 | 26.3 | 15.6 | 43 |
| 8.5 | 23.5 | 21 | 29 | 33 | 23.2 | 43 |

Active Oxygen Measurements at pH 8.5, 9.5, and 10.8 for N-Cyanophthalimide

*Experimental conditions were solutions of pH 8.5, 9.5, of 10.8 containing 50 ppm N-cyanophthalimide, a two-fold excess of hydrogen peroxide, and Dequest 2006 ™ as noted.

In the measurement of AO generation by N-cyanophthalimide it was found that the order of reagent addition was very important to the yield of AO measured. If, as was done for all other compounds tested, the addition of N-cyanophthalimide was made either within one minute, simultaneously, or after the addition of peroxide a good yield of AO was obtained in any solution of alkaline pH. However, in alkaline solutions of pH greater than 11, if the N-cyanophthalimide was added 10 to 20 minutes prior to the addition of peroxide there was virtually no AO observed. These observations suggested that N-cyanophthalimide can undergo hydrolysis in very alkaline solutions if peroxide is absent.

In practice, no noticeable effect of the order of addition will be observed. Normally, a product is formulated to contain both peroxide bleach and activator so that both ingredients will be added almost simultaneously.

Activator embodiments of the invention are expected to demonstrate good stain removal on cotton over a broad range of stains. For instance, N-cyanophthalimide has been tested as giving significantly better bleaching of fountain pen ink as compared with prior art activators as shown in Table 5.

TABLE 5

Stain Removal Performance on Fountain Pen Ink

| Activator Added | ppm Activator | ppm Bleach | % SRE of Fountain Pen Ink from cotton after 12 minutes |
|---|---|---|---|
| N-Cyanophthalimide | 15 | 75 | 77.4 |
| N-Cyanolauramide | 15 | 75 | 61.3 |
| Morpholine Carbonitrile | 15 | 75 | 71.6 |
| Piperidine Carbonitrile | 15 | 75 | 71.1 |
| N,N'-Diethylcyanamide | 15 | 75 | 63.3 |
| — | 0 | 75 | 65.4 |

All treatments for which the data is summarized in Table 5 included detergent (1.0 g/L Tide® detergent), a metal sequestering agent (10 ppm aminopolyphosphonate), a buffer of 0.6 g/L sodium carbonate and 0.3 g/L sodium bicarbonate, with the hardness level adjusted to 100 ppm as $CaCO_3$ (Ca/Mg=3/1 on a molar basis). The peroxide-based bleach and/or activator were then added to the wash to achieve the final concentrations listed in the table. Hydrogen peroxide was added as a commercially available 30% aqueous solution. Stain removal was determined by making pre-wash and post-wash reflectance measurements on a Hunter Colorimeter and by washing for 12 minutes in a U.S. Testing Terg-O-Tometer bath maintained at a temperature of 100° F.

Delivery Systems

The inventive activators are formulated with a source of peroxygen, such as a solid alkaline peroxide. Suitable sources of peroxide include sodium perborate monohydrate, sodium perborate tetrahydrate, sodium carbonate peroxyhydrate, sodium pyrophosphate peroxyhydrate, urea peroxyhydrate, sodium peroxide, and mixtures thereof. Sodium perborate monohydrate and sodium perborate tetrahydrate are particularly preferred alkaline peroxides for combination with the activators as a dry bleach composition or, when surfactant is included, as a dry laundering and bleaching composition.

Bleaching compositions in accordance with the invention perform best when the activator compound and the peroxygen source are dissolved in an aqueous based solution at a pH of greater than about 7.5, more preferably a pH between about 10 to about 11. Thus, compositions of the invention can advantageously further comprise one or more of a pH adjusting agent effective to adjust or to maintain the pH of a solution in which the oxidizing agent is dissolved to a pH greater than about 7.5 (and usually not to exceed about 13, more preferably about 12). Suitable pH adjusting agents, or buffers, are well known to the art and include, for example, carbonates, borates, phosphates, silicates, and bicarbonates.

Another desirable component for the inventive compositions is a metal sequestering agent, which is useful to increase stability of peroxide-containing solutions, such as is noted by U.S. Pat. No. 4,294,575, inventor Kowalski, issued Oct. 13, 1981. Among the useful metal sequestering agents are sodium citrate, STPP, and EDTA. Other useful heavy metal chelating ligands are well known in the art. A particularly preferred metal sequestering agent is a mixture of an alkaline metal phosphonate and an alkaline metal polyphosphonate, available as a series under the trademark "Dequest™" from Monsanto, "Briquest™" available from Albright & Wilson, and "Bayhibit AM™" available from Mobay.

The overall composition of the bleaching products of this invention can vary widely depending upon the amount of optional ingredients such as builders, surfactants, and bulking agents. Therefore the actual composition of the products themselves is not considered to be as important as the ratios between the two essential components. The ranges of essential peroxygen and activator compound in compositions of the invention intended for fabric bleaching are preferably where peroxygen is in a molar ratio with respect to activator compound of about 1:1 or greater. Particularly preferred are ratios of about 2:1 or even more preferably 3:1. Results indicate that molar ratios of up to 100:1 can be used successfully.

The amount of inventive activator in the inventive compositions may be such as to yield concentrations of from about 0.1 to about 1,000 ppm in the wash liquid (about $6.25\times10^{-6}$M to about $6.25\times 10^{-2}$M). Compositions of the invention with the essential activator and peroxide source can include various wash aids. For example, wash aids may include enzymatic stain removers, which are enzymes capable of hydrolyzing substrates, e.g., stains. Under the International Union of Biochemistry, accepted nomenclature for these types of enzymes is hydrolases. Hydrolases include, but are not limited to, proteases, amylases (carbohydrases), lipases (esterases), cellulases, and mixtures thereof. Proteases, especially so-called alkaline proteases, are commonly employed as wash aids, since they attack protein substrates and digest them, e.g., troublesome stains such as blood and grass.

Commercially available alkaline proteases are derived from various strains of the bacterium *Bacillus subtilis*. These proteases are also known as subtilisins. Nonlimiting examples thereof include the proteases available under the trademarks Esperase®, Savinase®, and Alcalase®, from Novo Nordisk A.S., of Bagsvaerd, Denmark; those sold under the trademarks Maxatase™, and Maxacal® from Gist-Brocades N.V. of Delft, Netherlands; and those sold under the trademark Milezyme® APL, from Miles Laboratories, Elkhart, Ind. Mixtures of enzymes are also included in this invention. See, also, U.S. Pat. No. 4,511,490, issued to Stanislowski et al, incorporated herein by reference. These commercially available proteases are supplied in prilled, powdered, or comminuted forms. These enzymes can include a stabilizer, such as triethanolamine, clays, or starch.

Other enzymes may also be incorporated. Thus, lipases, which digest fatty substrates, and amylases, which digest starch substrates, can be used in the compositions. These two types of enzymes are available commercially. Lipases are described in U.S. Pat. No. 3,950,277, column 3, lines 15–55, the description of which is incorporated herein by reference. Suitable amylases (and their sources) include Rapidase® (Societe Rapidase, France), Maxamyl® (Gist-Brocades), Termamyl® (Novo Nordisk), and Milezyme® DAL (Miles Laboratories). Cellulases may also be desirable for incorporation and description of exemplary types of cellulases is found from the specifications of U.S. Pat. No. 4,479,881, issued to Tai; U.S. Pat. No. 4,443,355, issued to Murata et al; U.S. Pat. No. 4,435,307, issued to Barbesgaard et al; and U.S. Pat. No. 3,983,002, issued to Ohya et al, all of which are incorporated herein by reference. Oxidases can also be included.

Another optional wash aid which can be incorporated into inventive compositions are fluorescent whiteners or optical brighteners. Representative fluorescent whitening agents include the naphtholtriazol stilbene and distyryl biphenyl fluorescent whitening agents sold by the Ciba-Geigy Corporation under the names Tinopal® RBS and Tinopal® CBS-X respectively, and the stilbene materials also marketed by Ciba-Geigy under the name Tinopal® 5BMX. Other useful whiteners are disclosed in columns 3, 4, and 5 of U.S. Pat. No. 3,393,153 and further useful whiteners are disclosed in ASTM publication D-553A, List of Fluorescent Whitening Agents for the Soap and Detergent Industry, which disclosures are incorporated herein by reference.

Yet another class of wash aids which can be incorporated are fragrances, which can be selected from materials well known to the art.

The compositions of this invention may, if desired, also contain additional components such as colorants, primary cleansing agents (surfactants), fabric softening agents, detergency builders, and bulking agents. Colorants can be selected from materials well known to the art.

Representative surfactants include conventional anionic, cationic, nonionic, ampholytic and zwitterionic surfactant materials as are described in the art. Examples of suitable surfactants for use in these formulations may be found in Kirk-Othmer, Encyclopedia of Chemical Technology, 3rd Edition, volume 22, pages 247–387 (1983) and McCutcheon's Detergents and Emulsifiers, North American Edition (1983). These two disclosures are incorporated herein by reference. One generally preferred group of surfactants are the nonionic surfactants such as are described at pages 360–377 of Kirk-Othmer. Nonionic materials include alcohol ethoxylates, alkyl phenol ethoxylates, carboxylic acid esters, glycerol esters, polyoxyethylene esters, anhydrosorbitol esters, ethoxylated anhydrosorbitol esters, ethoxylates of natural fats, oils and waxes, glycol esters of fatty acids carboxylic amides, diethanolamine condensates, monoalkanolamine condensates, polyoxyethylene fatty acid amides, polyalkylene oxide block copolymers, poly(oxyethylene-co-oxypropylene) nonionic surfactants and the like. A wide range of such materials are available commercially, including the Shell Chemical Neodols®, the Union Carbide Tergitols®, the ICI Tween® series, and the Span® series and the like. Preferably, surfactants range from 0 to about 60% by weight of the inventive composition.

Detergency builders which may optionally be added to the bleach compositions can be selected from the detergency builders commonly added to detergent formulations. Useful builders include any of the conventional inorganic and organic water-soluble builder salts. Useful inorganic builder salts include, for example, water-soluble salts of phosphates, pyrophosphates, orthophosphates, polyphosphates, silicates, carbonates, and the like. Organic builders include water-soluble phosphonates, polyphosphonates, polyhydroxysulfonates, polyacetates, carboxylates, polycarboxylates, succinates, and the like. Preferably, detergency builders range from about 5% to about 80% by weight of the inventive composition.

Specific examples of inorganic phosphate builders include sodium and potassium tripolyphosphates, pyrophosphates, and hexametaphosphates. The organic polyphosphonates specifically include, for example, the sodium and potassium salts of ethane-1-hydroxy-1,1-diphosphonic acid and the sodium and potassium salts of ethane-1,1,2-triphosphonic acid. Examples of these and other phosphorous builder compounds are disclosed in U.S. Pat. Nos. 3,213,030; 3,422,021; 3,422,137; and 3,400,176. Pentasodium tripolyphosphate and tetrasodium pyrophosphate are especially preferred water-soluble inorganic builders.

Specific examples of nonphosphorous inorganic builders include water-soluble inorganic carbonate, bicarbonate, and silicate salts. The alkali metal, for example, sodium and potassium, carbonates, bicarbonates, and silicates are particularly useful herein.

Water-soluble organic builders are also useful. For example, the alkali metal, ammonium and substituted ammonium polyacetates, carboxylates, polycarboxylates, and polyhydroxysulfonates are useful builders for the compositions and processes of the invention. Specific examples of polyacetate and polycarboxylate builders include sodium, potassium, lithium, ammonium, and substituted ammonium salts of ethylene diaminetetraacetic acid, nitrilotriacetic acid, benzene polycarboxylic (i.e., penta- and tetra-) acids, carboxymethoxysuccinic acid and citric acid.

Water-insoluble builders may also be used, particularly the complex sodium alumino silicates such as zeolites, e.g., zeolite 4 A, a type of zeolite molecular sieve wherein the univalent cation is sodium and the pore size is about 4 Å. The preparation of such type zeolite is described in U.S. Pat. No. 3,114,603. The zeolite may be amorphous or crystalline and have waters of hydration as is known in the art.

Fillers or bulking agents may also be included in the bleaching compositions of the invention. A preferred filler salt is an alkali metal sulfate or an alkali chloride, such as potassium or sodium sulfate, the latter being especially preferred.

An inventive composition could be formulated as follows:

| | |
|---|---|
| Peroxygen material | 0.5–30% wt. |
| Activator | 0.5–30% wt. |
| Optional preferred metal seq. agent | 0–5% wt. |
| Buffer | 0–75% wt. |
| Various other optional materials | reminder |

The bleaching compositions of the invention may be prepared by admixing the ingredients. When preparing solid combination products with surfactants and/or builder salts, the peroxygen compound and activator can be mixed either directly with the wash aids, surfactant, builder, and the like, or peroxygen compound and activator can be separately or collectively coated with a coating material to prevent premature activation of the bleaching agent. The coating process is conducted in accordance with procedures well known in the art. Suitable coating materials include compounds such as magnesium sulfate, polyvinyl alcohol, lauric acid or its salts, and the like.

The materials of this invention find particular application, without limitation, in commercial and domestic laundry settings, and can be added to the prewash segment, the wash segment or a rinse segment of the overall cycle. Most commonly, it is preferred to add the materials to the wash segment of the cycle.

The conditions of use can include cold water and hot water wash conditions with water temperatures ranging from a low of about 33° F. to a high of about 212° F.

It is to be understood that while the invention has been described above in conjunction with preferred specific embodiments, the description and examples are intended to illustrate and not limit the scope of the invention, which is defined by the scope of the appended claims.

It is claimed:

1. A composition, useful for bleaching, comprising:

(a) an activator compound, the activator compound having either of the following structures

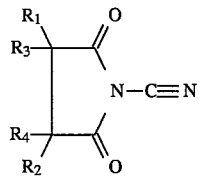

or

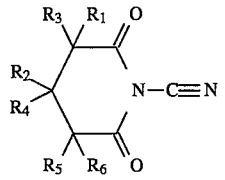

where $R_1$ and $R_2$ taken together with the carbon atoms to which they are attached form a ring containing 4 to 6 carbon atoms, whereby the carbon atoms in the ring may be singly or multiply substituted with hydrogen, $C_1$–$C_{20}$ alkyl, $C_1$–$C_{20}$ alkoxy, $C_1$–$C_{20}$ alkanoyl, phenyl, benzoyl, middle halogen, amino, amine salt, phosphate or phosphonate group, sulfate or sulfonate group, cyano or cyanoamino group, or with a cyclic group of 4 to 6 carbon atoms, or with a nitrogen-containing heterocyclic group of 4 to 6 atoms, or where $R_1$ and $R_2$ taken together with the carbon atoms to which they are attached form a heterocyclic ring containing 5 to 7 atoms containing one or two hetero atoms selected from the group consisting of O, S, and N—$R_7$, where $R_7$ is hydrogen or a $C_1$–$C_{20}$ alkyl, $C_1$–$C_{20}$ alkoxy, $C_1$–$C_{20}$ alkanoyl, $C_2$–$C_{20}$ alkenyl, $C_2$–$C_{20}$ alkynyl, phenyl, benzoyl, middle halogen, amino, amine salt, phosphate or phosphonate group, sulfate or sulfonate group, cyano or cyanoamino group, and where $R_3$, $R_4$, $R_5$, and $R_6$ are the same or different and independently represent hydrogen, $C_1$–$C_{20}$ alkyl (straight chain, branched chain, or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, benzoyl, $C_7$–$C_{20}$ aralkyl, alkenylcyanoamino; or where $R_1$, $R_2$, $R_3$, $R_4$, $R_5$, and $R_6$ are the same or different and independently represent hydrogen, $C_1$–$C_{20}$ alkyl (straight chain, branched chain, or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, benzoyl, $C_7$–$C_{20}$ aralkyl, alkenylcyanoamino, or a polyalkenylamino of the type

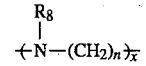

where n=1 or 2 and X is 1–10 and $R_8$ is hydrogen or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or an amine salt, carboxylate, phosphate or phosphonate group, sulfate or sulfonate group, cyano, cyanoamino or hydroxyl group; and, (b) a peroxygen source in a sufficient amount to form an oxidizing agent derivative of the activator compound when the peroxygen source and the activator are in a solvent therefor.

2. The composition as in claim 1 further comprising at least one pH adjusting agent, at least one metal sequestering agent, or at least one of each of said pH adjusting and said metal sequestering agents.

3. The composition as in claim 2 wherein the pH adjusting agent is effective to adjust or to maintain the pH of a solution in which the oxidizing agent is dissolved to a pH greater than about 7.5.

4. The composition as in claim 2 wherein the pH adjusting agent is effective to adjust or to maintain the pH of a solution in which the oxidizing agent is dissolved to a pH between about 7.5 to about 12.

5. The composition as in claim 2 wherein the metal sequestering agent includes a phosphonate, a polyphosphate, or mixtures thereof.

6. The composition as in claim 1 wherein the peroxygen source provides peroxygen in a molar ratio with respect to the activator compound of greater than about 1:1.

7. The composition as in claim 1 wherein the activator comprises N-cyanophthalimide.

8. The composition as in claim 1 wherein the activator comprises N-cyanosuccinimide.

9. The composition as in claim 1 is in granular form.

10. The composition as in claim 9 wherein the peroxygen source is in a bleach effective amount.

11. The composition as in claim 1 which further comprises at least one surfactant, wherein said surfactant comprises up to about 60% by weight of said composition.

12. The composition as in claim 11 which further comprises a detergency builder in an amount of about 5% to about 80% by weight of said composition.

13. The composition as in claim 11 which further comprises an enzyme selected from the group consisting of proteases, cellulases, lipases, amylases, oxidases, and mixtures thereof.

14. A method for bleaching or cleaning a substrate comprising the step of contacting the substrate with a composition as in claim 1.

15. The method as in claim 14 wherein the substrate is selected from the group consisting of laundry, dishes, textiles, paper, and wood pulp.

16. A composition, useful for bleaching, comprising:

(a) an activator compound, the activator compound having the structure

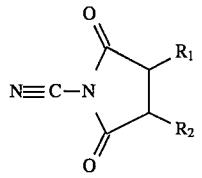

where $R_1$ and $R_2$ taken together with the carbon atoms to which they are attached form an aromatic ring containing 4 to 6 carbon atoms, whereby the carbon atoms in the ring may be singly or multiply substituted with hydrogen, $C_1$–$C_{20}$ alkyl, $C_1$–$C_{20}$ alkoxy, $C_1$–$C_{20}$ alkanoyl, phenyl, benzoyl, middle halogen, amino, amine salt, phosphate or phosphonate group, sulfate or sulfonate group, cyano or cyanoamino group, or with a cyclic group of 4 to 6 carbon atoms, or with a nitrogen-containing heterocyclic group of 4 to 6 atoms, or where $R_1$ and $R_2$ taken together with the carbon atoms to which they are attached form an aromatic heterocyclic ring containing 5 to 7 atoms containing one or two hetero atoms selected from the group consisting of O, S, and N—$R_7$, where $R_7$ is hydrogen or a $C_1$–$C_{20}$ alkyl, $C_1$–$C_{20}$ alkoxy, $C_1$–$C_{20}$ alkanoyl, $C_2$–$C_{20}$ alkenyl, $C_2$–$C_{20}$ alkynyl, phenyl, benzoyl, middle halogen, amino, amine salt, phosphate or phosphonate group, sulfate or sulfonate group, cyano or cyanoamino group, and where $R_1$ and $R_2$ are the same or different and independently represent hydrogen, $C_1$–$C_{20}$ alkyl (straight chain, branched chain, or cycloalkyl), $C_2$–$C_{20}$ alkenyl, $C_2$–$C_{20}$ alkynyl, $C_1$–$C_{20}$ alkanoyl, $C_1$–$C_{20}$ ethoxylate or propoxylate, phenyl, benzoyl, $C_7$–$C_{20}$ aralkyl, alkenylcyanoamino, or a polyalkenylamino of the type

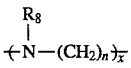

where n=1 or 2 and X is 1–10 and $R_8$ is hydrogen or cyano, a Group IA metal, or any of the foregoing radicals containing a substitutable carbon atom on which is substituted a $C_1$–$C_5$ alkyl, $C_1$–$C_5$ alkoxy, $C_1$–$C_5$ alkanoyl, middle halogen, amino or an amine salt, carboxylate, phosphate or phosphonate group, sulfate or sulfonate group, cyano, cyanoamino or hydroxyl group; and, (b) a peroxygen source in a sufficient amount to form an oxidizing agent derivative of the activator compound when the peroxygen source and the activator are in a solvent therefor.

17. The composition as in claim 16 further comprising at least one pH adjusting agent, at least one metal sequestering agent, or at least one of each of said pH adjusting and said metal sequestering agents.

18. The composition as in claim 17 wherein the pH adjusting agent is effective to adjust or to maintain the pH of a solution in which the oxidizing agent is dissolved to a pH greater than about 7.5.

19. The composition as in claim 17 wherein the pH adjusting agent is effective to adjust or to maintain the pH of a solution in which the oxidizing agent is dissolved to a pH between about 7.5 to about 12.

20. The composition as in claim 17 wherein the metal sequestering agent includes a phosphonate, a polyphosphate, or mixtures thereof.

21. The composition as in claim 16 wherein the peroxygen source provides peroxygen in a molar ratio with respect to the activator compound of greater than about 1:1.

22. The composition as in claim 16 wherein the activator comprises N-cyanophthalimide.

23. The composition as in claim 16 is in granular form.

24. The composition as in claim 23 wherein the peroxygen source is in a bleach effective amount.

25. The composition as in claim 16 which further comprises at least one surfactant, wherein said surfactant comprises up to about 60% by weight of said composition.

26. The composition as in claim 25 which further comprises a detergency builder in an amount of about 5% to about 80% by weight of said composition.

27. The composition as in claim 25 which further comprises an enzyme selected from the group consisting of proteases, cellulases, lipases, amylases, oxidases, and mixtures thereof.

28. A method for bleaching or cleaning a substrate comprising the step of contacting the substrate with a composition as in claim 16.

29. The method as in claim 28 wherein the substrate is selected from the group consisting of laundry, dishes, textiles, paper, and wood pulp.

* * * * *

US005478356B1

REEXAMINATION CERTIFICATE (3386th)

United States Patent [19]

Kaaret

[11] B1 5,478,356

[45] Certificate Issued Nov. 18, 1997

[54] CYANOIMIDES AND COMPOSITIONS USEFUL FOR BLEACHING

[75] Inventor: Thomas W. Kaaret, Alamo, Calif.

[73] Assignee: Clorox Company, Oakland, Calif.

Reexamination Request:
No. 90/004,397, Sep. 30, 1996

Reexamination Certificate for:

| | |
|---|---|
| Patent No.: | **5,478,356** |
| Issued: | **Dec. 26, 1995** |
| Appl. No.: | **240,248** |
| Filed: | **May 10, 1994** |

[51] Int. Cl.[6] ..... D06L 3/02; C11D 3/28; C11D 3/395

[52] U.S. Cl. ..... 510/226; 8/111; 134/2; 252/186.38; 252/186.39; 510/305; 510/306; 510/313; 510/374; 510/376; 510/500

[58] Field of Search ..... 510/314, 313, 510/376, 500; 252/194, 186.38, 186.39; 134/2; 8/111

[56] References Cited

U.S. PATENT DOCUMENTS

| | | | |
|---|---|---|---|
| 2,927,840 | 3/1960 | Dithmar et al. | 8/111 |
| 2,992,223 | 7/1961 | Frazza et al. | 546/243 |
| 3,113,951 | 12/1963 | Williams | 549/531 |
| 3,163,606 | 12/1964 | Viveen et al. | 252/186.43 |
| 3,583,924 | 6/1971 | Demangeon et al. | 510/376 |
| 3,756,774 | 9/1973 | Kirner et al. | 8/111 |
| 3,840,466 | 10/1974 | Gray et al. | 510/306 |
| 3,882,035 | 5/1975 | Loffelman et al. | 510/313 |
| 3,928,223 | 12/1975 | Murray | 510/313 |
| 4,025,453 | 5/1977 | Kravetz et al. | 510/314 |
| 4,086,175 | 4/1978 | Kravetz et al. | 510/314 |
| 4,199,466 | 4/1980 | Benson, Jr. | 510/314 |
| 4,393,975 | 7/1983 | Tourdot et al. | 8/111 |
| 4,397,757 | 8/1983 | Bright et al. | 252/186.41 |
| 4,559,158 | 12/1985 | Hase et al. | 510/314 |
| 4,563,474 | 1/1986 | Franke et al. | 514/417 |
| 4,756,845 | 7/1988 | Sugawara et al. | 424/613 |
| 4,915,863 | 4/1990 | Aoyagi et al. | 510/376 |
| 5,087,385 | 2/1992 | Zielske | 252/186.39 |

FOREIGN PATENT DOCUMENTS

| | | |
|---|---|---|
| 0008475 | 3/1980 | European Pat. Off. . |
| 0443640 | 8/1991 | European Pat. Off. . |
| 0464880 | 1/1992 | European Pat. Off. . |
| 1953919 | 10/1969 | Germany . |
| 3514877 | 11/1986 | Germany . |
| 63-161089 | 7/1988 | Japan . |
| 02229895 | 9/1990 | Japan . |
| 1417356 | 12/1975 | United Kingdom . |
| 1573143 | 8/1980 | United Kingdom . |
| 2129458 | 5/1984 | United Kingdom . |
| 2175621 | 12/1986 | United Kingdom . |
| WO9115474 | 10/1991 | WIPO . |

OTHER PUBLICATIONS

Makhon'kov et al., *"Reactions of Tetracyanomethane and Chlorotricyanomethane with the Anions of Dibasic Acid Imides,"* J. Org. Chem., USSR (English translation), 13, pp. 890–893 (1977).

Sheludyakov et al., *Synthesis and Properties of Diacylcarbamoyl Chlorides and Compounds Derived from Them,* J. Gen. Chem. USSR (English translation), 47, pp. 974–978 (1977).

Wiberg, *"The Mechanisms of Hydrogen Peroxide Reactions. I. The Conversion of Benzonitrile to Benamide,"* J. Amer. Chem. Soc. 75, pp. 3961–3964 (1953).

Wiberg, *"The Mechanisms of Hydrogen Peroxide Reactions. II. A Comparison of the Reactivity of Hydroxyl Ion and Hydroperoxide Ion Toward Benzonitrile"*, J. Amer. Chem. Soc. 77, 2519–2522 (1955).

*Primary Examiner*—Ardith Hertzog

[57] ABSTRACT

Cyanoamine activators give excellent bleaching performance when combined with a peroxygen source and dissolved in solution. Activators include imides wherein each activator has two acyl groups attached to a common nitrogen and to a cyclic moiety, with the nitrogen being cyano substituted. The two acyl groups from intermediate peroxy groups in the presence of a peroxygen source in solution. Preferred activators include N-cyanophthalimide and N-cyanosuccinimide.

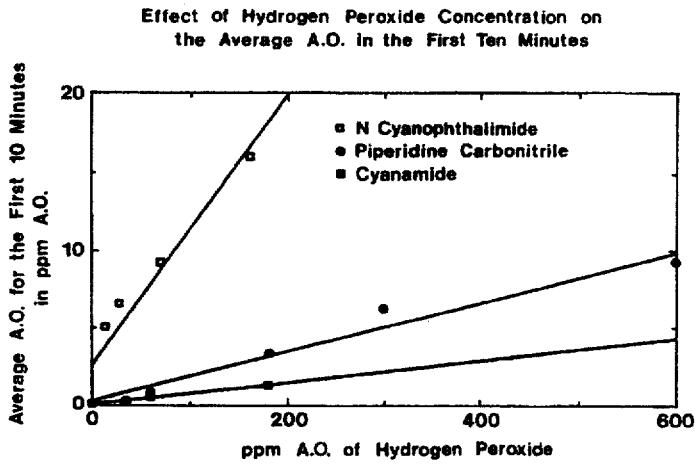

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Title page, and column 1, line 1:

[Cyanomines] *Cyanoimides* and compositions useful for bleaching.

AS A RESULT OF REEXAMINATION, IT HAS BEEN DETERMINED THAT:

The patentability of claims 1–29 is confirmed.

* * * * *